United States Patent [19]

Kittler, Reinhold

[11] Patent Number: 4,770,001

[45] Date of Patent: Sep. 13, 1988

[54] SWIMMING POOL DEHUMIDIFIER

[75] Inventor: Kittler, Reinhold, Hudson Heights, Canada

[73] Assignee: Dectron, Inc., Montreal, Canada

[21] Appl. No.: 33,915

[22] Filed: Apr. 1, 1987

Related U.S. Application Data

[63] Continuation of Ser. No. 791,111, Oct. 24, 1985, abandoned, which is a continuation of Ser. No. 127,444, Mar. 5, 1980, Pat. No. 4,557,116.

[30] Foreign Application Priority Data

Nov. 28, 1979 [CA] Canada ..... 340815

[51] Int. Cl.[4] ..... F25B 27/02

[52] U.S. Cl. ..... 62/238.6

[58] Field of Search ..... 62/238.6

[56] References Cited

U.S. PATENT DOCUMENTS

| | | | |
|---|---|---|---|
| 1,874,803 | 8/1932 | Reed | 62/238.6 X |
| 2,752,759 | 7/1956 | Sperzel | 62/159 |
| 3,498,072 | 3/1970 | Stiefel | 62/238.6 X |
| 3,513,663 | 5/1970 | Martin, Jr. et al. | 62/238.6 X |
| 3,926,008 | 12/1975 | Webber | 62/238.6 X |
| 3,976,123 | 8/1976 | Davies | 62/238.6 X |
| 4,094,167 | 6/1978 | Madsen | 62/238.6 |

*Primary Examiner*—Lloyd L. King

*Attorney, Agent, or Firm*—A. W. Breiner

[57] ABSTRACT

A dehumidifying system for use in a building housing a swimming pool. The system includes a refrigerant compressor, a dehumidifier coil for dehumidify ing air within the building, an air cooled condenser for reheating the air previously cooled down in the dehumidifying coil as well as for heating the swimming pool enclosure and a water cooled condensor for heating the pool water. The heat developed in the system can be used to selectively heat the dehumidified air within the building and the water in the swimming pool. The water obtained during dehumdification of the air is collected and returned to the swimming pool.

5 Claims, 1 Drawing Sheet

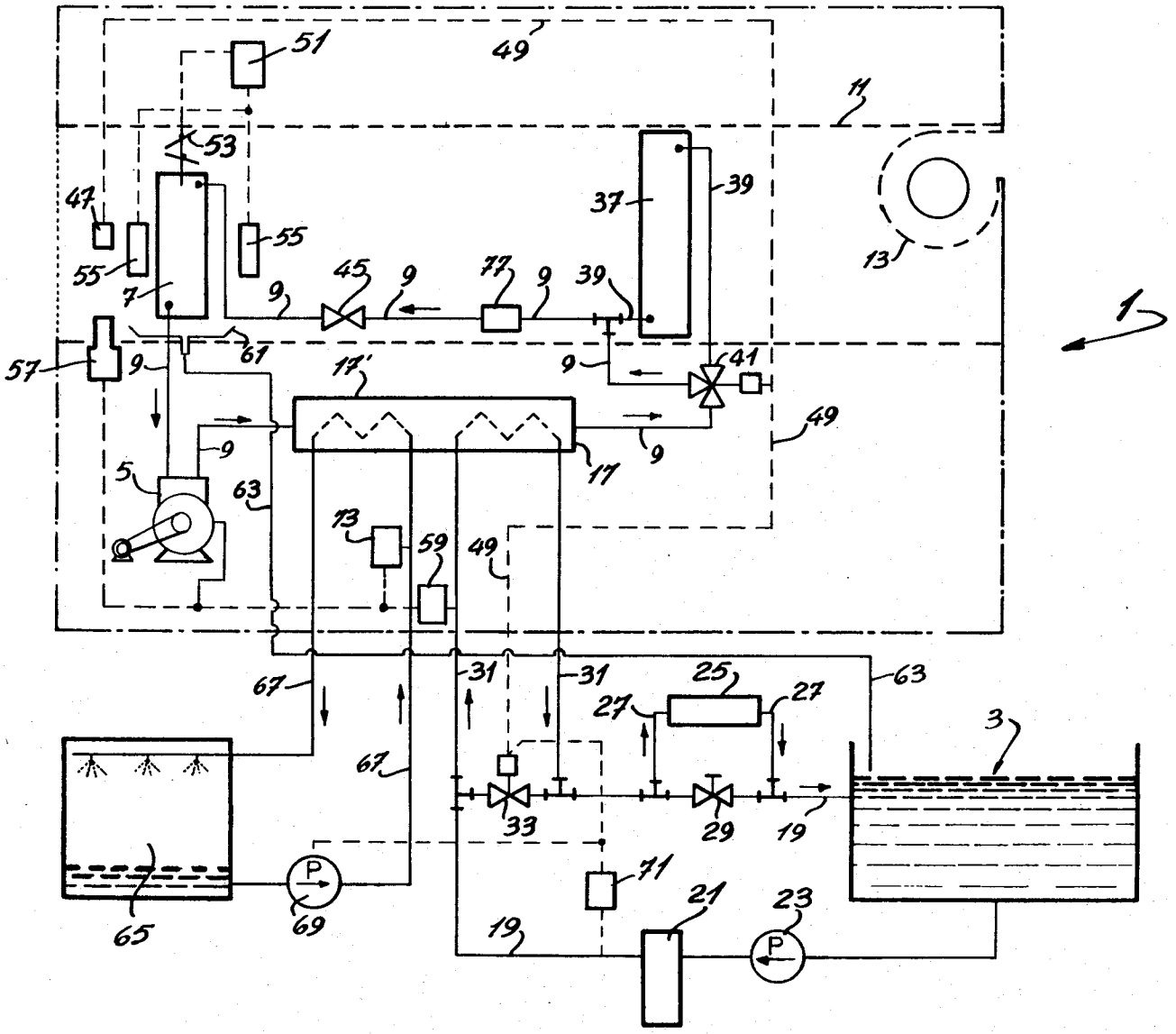
1
3
5
7
9
11
13
17
19
21
23
25
27
29
31
33
37
39
41
45
47
49
51
53
55
57
59
61
63
65
67
69
P

SWIMMING POOL DEHUMIDIFIER

This is a continuation of application Ser. No. 06/791,111 filed Oct. 24, 1985, now abandoned, which in turn is a continuation of application Ser. No. 06/127,444 filed Mar. 5, 1980, now U.S. Pat. No. 4,557,116.

This invention is directed toward a dehumidifying system.

The invention is more particularly directed toward a dehumidifying system for use with indoor swimming pools.

Indoor swimming pools normally have a serious humidity problem if the amount of moisture in the air is not controlled and reduced. The humidity within the buildings housing the swimming pools is then too high due to normal evaporation of water from the pool surface. This humidity problem is presently solved by moving out the moist air from within the swimming pool buidling and replacing it with drier outside air. This method will only work efficiently when the outside air has a lower moisture content. However, in colder weather, the outside air coming in must be heated. Also, due to a large amount of pool water being evaporated, make-up water must be added to the pool and this make-up water must be heated. In addition, the evaporation of the pool water removes heat from the remaining pool water requiring an additional heat input to maintain the water in the swimming pool at a suitable swimming temperature. From the above it will be seen that a tremendous amount of energy is required in cold weather to maintain the temperature and humidity levels within an enclosed swimming pool at acceptable levels.

The present invention provides means for controlling the humidity in enclosed swimming pools using much less energy than the amount of energy previously used to control the humidity.

In accordance with the present invention, a dehumidifier is provided within the building housing a swimming pool to dehumidify the air within the building. The heat generated in the dehumidifier during the dehumidification process is recovered when needed and is used to heat the water in the swimming pool and/or to heat the dehumidified air. In addition the water collected during the dehumidification process is returned to the swimming pool to reduce the amount of make-up water required. It will be seen from the above that a tremendous amount of energy can be saved using a dehumidifier system which can effectively utilize the heat generated from the dehumidification process. The system also includes means for dissipating the heat generated in the system when the heat is not required during the summer.

The invention is particularly directed toward a dehumidifying system for use in a building housing a swimming pool. The system has a refrigerant compressor, a pool water heater, an air heater and a dehumidifying coil. The system also includes blower means for passing air within the building over the dehumidifying coil and then over the air heater. Means are provided for circulating refrigerant from the compressor to the dehumidifying coil and back to the compressor. Means are also provided for using the refrigerant in the pool water heater and the air heater, in passing from the dehumidifying coil to the compressor, to heat the pool water and the dehumidified air.

The system includes means for having the refrigerant bypass the air heater when air heating is not required. Air temperature sensing means operate the by-pass means.

The system also includes means for circulating pool water through the pool water heater and means for controlling the amount of pool water circulated through the pool water heater.

The invention will now be described in detail having reference to the accompanying single FIGURE which is a schematic view of the dehumidifying system.

As shown in the FIGURE, the dehumidifying system 1 for a building housing an indoor swimming pool 3, has a refrigerant compressor 5 and a dehumidifying coil 7. A refrigerant line 9 leads from the compressor 5, to the water cooled condenser 17, to the valve 41, to the air cooled condenser coil 37, to the filter drier 77 to the expansion valve 45 to the dehumidifying coil 7 and back to the compressor 5 for circulating a refrigerant through the system. The dehumidifying coil 7 is mounted in a system enclosure 1 within the building and a blower 13 is provided for circulating air within the building through the system enclosure 11 and past the coil 7 to dehumidify the moist air within the building.

The system 1 includes means to heat the water in swimming pool 3. The heating means comprises a water heat exchanger 17 downstream from compressor 5. The swimming pool 3 has a standard water recirculating line 19 with a filter 21 in the line, a recirculating pump 23 in the line, and a covnentional pool heater 25 in a by-pass line 27 associated with recirculating line 19. A valve 29 in line 19 controls flow through by-pass line 27. The heat exchanger 17 is connected to the recirculating line 19 by a branch line 31 ahead of the conventional pool heater. A regulating valve 33 in line 19 controls the flow of pool water through branch line 31 and heat exchanger 17.

The main refrigerant line 9 passes through heat exchanger 17 carrying hot refrigerant gas from compressor 5 which gas is used to heat any pool water carried to heat exchanger 17 by branch line 31.

The system 1 also includes means to heat the dehumidified air. The air heating means comprises an air heat exchanger having a condenser coil 37 positioned within system enclosure 11 downstream of the dehumidifying coil 7 with reference to the air stream. A branch refrigerant line 39 leads from main refrigerant line 9, downstream of the water heat exchanger 17, to the condenser coil 37 and back to main line 9. A three-way valve 41 in line 9 controls flow to branch line 39. When it is desired to heat the air, valve 41 is positioned to direct hot refrigerant gas through condenser coil 37 where it heats the air passed over coil 37 by blower 13.

An expansion valve 45 is located in refrigerant line 9 downstream of condenser coil 37. The refrigerant passes through valve 45 and is injected into dehumidifying coil 7.

A thermostat 47 is located in system enclosure 11 upstream of dehumidifying coil 7 and is used to control, via line 49, the position of regulating valve 33. This controls the amount of pool water heated and thus also indirectly controls the amount of heat transferred into the air. Thermostat 47 also controls, via line 49, the position of three-way valve 41.

The dehumidification of the air is obtained by cooling the air below the dew point. When the temperature of the air is reduced below the dew point, condensation of the moisture occurs. In the present invention there is provided an automatic air temperature compensation device 51 to control the amount of air passing through the dehumidifying coil 7 in system enclosure 11. The device 51 comprises a motorized by-pass member 53 in system enclosure 11 for by-passing air around the coil 7 and temperature or enthalpy control devices 55. The amount of air passing through the coil 7 is metered by varying the position of damper 53 depending on the moisture and heat content of the air entering the coil. This will establish and adjust continuously for the most efficient sensible heat ratio in order to remove a maximum amount of moisture for a given compressor capacity. For example, if the maximum volume of air were permitted to pass through coil 7 a large proportion of the available cooling capacity would be used to reduce the temperature of the air to the dew point and only a small proportion of the cooling capacity would be available to further cool the air to effect condensation of the moisture and dehumidification. By varying the position of damper 53 the volume of air can be reduced and a greater proportion of the cooling capacity would be available for dehumidification.

Ideally, the control device 55 would measure the enthalpy (total heat of the air) passing through coil 7. Enthalpy measuring devices, however, are complicated and expensive and it has been found that reasonable and satisfactory results can be obtained by employing a measuring device which would measure only the temperature and humidity of the air entering coil 7 and controlling the position of the damper 53 in order to obtain maximum dehumidification.

A humidistat 57 upstream of coil 7, and a water flow switch 59 in branch line 31, act to control the operation of the compressor 5.

Means are provided for returning the water removed from the air by dehumidifying coil 7 back to the pool 3. These water return means can comprise a drip tray 61 beneath coil 7 for collecting the water condensed on coil 7 and a water return line 63 leading from tray 61 to the pool 3.

Means can be provided for dissipating heat from the system when it is not required to heat either the pool water or the air. These means can comprise a water cooling tower 65 connected to a second water heat exchanger 17', adjacent first heat exchanger 17, by water line 67. A pump 69 in line 67 circulates water from cooling tower 65 to second heat exchanger 17', and back to tower 65. The heat from the refrigerant gas in main line 9 passing through the second heat exchanger is picked up by the water in second heat exchanger 17' and dissipated in the cooling tower 65. A thermostat 71 in the pool line 19, which also controls valve 33, controls pump 69. A water flow switch 73 in line 67, together with humidistat 57, also controls operation of the compressor 5.

The system can be used in various modes of operation depending on the dehumidifying and heating requirements. In one mode of operation, where the air is to be both dehumidified and heated and where the pool water is to be heated also, thermostat 47 senses the low air temperature in system enclosure 1 and operates valve 41 to pass refrigerant into coil 37. The thermostat 47 also acts to modulate valve 33 to send pool water through heat exchanger 17 to be heated. Valve 33 only closes however when water thermostat 71 determines that the pool water requires heating. High temperature, high pressure refrigerant gas from compressor 5 is partly cooled in heat exchanger 17 giving up heat to heat the pool water and condenses in condenser coil 37 giving up more heat to heat the air. The condensed refrigerant now passes to humidifying coil 7 where it evaporates taking in latent heat from the condensing water vapor in the humid air and sensible heat by cooling the air. The low pressure, low temperature refrigerant passes from humidifying coil to the compressor 5 where the cycle is repeated. The condensed water vapor is returned to the pool from dehumidifier coil 7 by return line 63.

If the pool water becomes hot enough during the dehumidifying process, thermostat 71 senses this and fully opens valve 33, over-riding thermostat 47 so as to stop circulating pool water through heat exchanger 17. Heating of the air continues however as before.

If now the air becomes hot enough as well, as sensed by thermostat 47, it operates valve 41 to have the refrigerant bypass condenser coil 37.

If the air does not require heating but the pool water does, thermostat 71 closes valve 33 to send pool water through heat exchanger 17. Thermostat 47 operates valve 41 to have the refrigerant by-pass condenser coil 37 as before.

Where no heating of the air or water is required during dehumidifying of the air, pump 69 is operated by thermostat 71 in the pool water circuit to circulate cooling water to the second heat exchange 17' to dissipate any excess heat in cooling tower 65.

The humidistat 57, and water flow switches 59 and 73 control the operation of compressor 5.

Heat exchangers 17, 17' could be built as one unit if desired.

The system described is very energy efficient in dehumidifying and heating a swimming pool building. For example, a building housing a swimming pool fourteen metres by twenty-five meters representing a semi-olympic pool size is desired to be maintained at 85° F. dry bulb temp.; 52% relative humidity; and 65° F. dew point temp. with the pool water temperature at 80° F. and having a rate of water evaporation from the pool at about 160 lb./hr. The energy required to maintain these conditions, using the conventional system of changing the air, when the outside air temperature is −20° F. is 142.2 KW. Even with the outside air temperature at 40° F., 112.0 KW of energy is required to maintain the desired conditions in the pool building. Using a dehumidifier system in accordance with the present invention however only 26 KW of energy is required regardless of the outside temperature. The heat transmission losses of the building are the same in both cases.

In addition, a significant saving in pool water occurs with the present system since the evaporated water taken out of the air is returned to the pool rather than being moved outside the building.

The embodiments of the invention in which an exclusive property or privilege is claimed are defined as follows:

1. A dehumidifying system for use in a building housing a swimming pool; the system comprising: a refrigerant compressor, a pool water heater, an air heater, and a dehumidifying coil, means for directing refrigerant from the compressor in sequence to the pool water heater, the air heater, the dehumidifying coil, and back to the compressor; means for directing air in the building, in sequence, over the dehumidifying coil and then over the air heater; means for circulating water from the swimming pool to the pool water heater and back to the swimming pool, and means for adjusting the amount of water circulated from the pool through the water heater.

2. A dehumidifying system as claimed in claim 1 including means in the air directing means to selectively bypass the dehumidifying coil with some of the air passing through the air directing means.

3. A dehumidifying system as claimed in claim 1 including means to selectively by-pass the air heater with refrigerant.

4. A dehumidifying system as claimed in claim 3 including means to selectively by-pass the pool water heater with pool water.

5. A dehumidifying system as claimed in claim 4 including means in the air directing means to selectively bypass the dehumidifying coil with some of the air passing through the air directing means.

* * * * *